US007434515B2

(12) United States Patent
O'Brien

(10) Patent No.: US 7,434,515 B2
(45) Date of Patent: Oct. 14, 2008

(54) SIGNAL TRANSMISSION FUSE

(75) Inventor: John P. O'Brien, Pawcatuck, CT (US)

(73) Assignee: Detotec North America, Inc., Sterling, CT (US)

( * ) Notice: Subject to any disclaimer, the term of this patent is extended or adjusted under 35 U.S.C. 154(b) by 147 days.

(21) Appl. No.: 11/452,571

(22) Filed: Jun. 14, 2006

(65) Prior Publication Data

US 2007/0289471 A1 Dec. 20, 2007

(51) Int. Cl.
*C06C 5/04* (2006.01)

(52) U.S. Cl. ..... 102/275.8; 102/275.1

(58) Field of Classification Search . 102/275.1–275.11, 102/289

See application file for complete search history.

(56) References Cited

U.S. PATENT DOCUMENTS 3,590,739 A 7/1971 Persson
4,290,366 A 9/1981 Janoski
4,328,753 A * 5/1982 Kristensen et al. ..... 102/275.5
4,817,673 A 4/1989 Zoghby et al.
5,212,341 A 5/1993 Osborne et al.
5,435,249 A 7/1995 Brent et al.
5,597,973 A 1/1997 Gladden et al.
6,647,887 B2 11/2003 Smith et al.
6,688,231 B1 2/2004 Herrmann

* cited by examiner

*Primary Examiner*—James S Bergin
(74) *Attorney, Agent, or Firm*—McCormick, Paulding & Huber LLP

(57) ABSTRACT

A small diameter shock tube of unique internal surface configuration such that the powder loading per meter of tubing can be higher than achieved with conventional shock tube. The outside diameter of the tube is less than 0.10", preferably 0.085" with inner and outer layers of different polymeric material bonded together in a coextrusion process. The inside surface of the shock tube has radially inwardly projecting ribs or protuberances that result in an increase of the internal perphi of the inner surface cross section achieving a 30% increase so that powder loading per meter of the tube can be kept in a safe range.

7 Claims, 1 Drawing Sheet

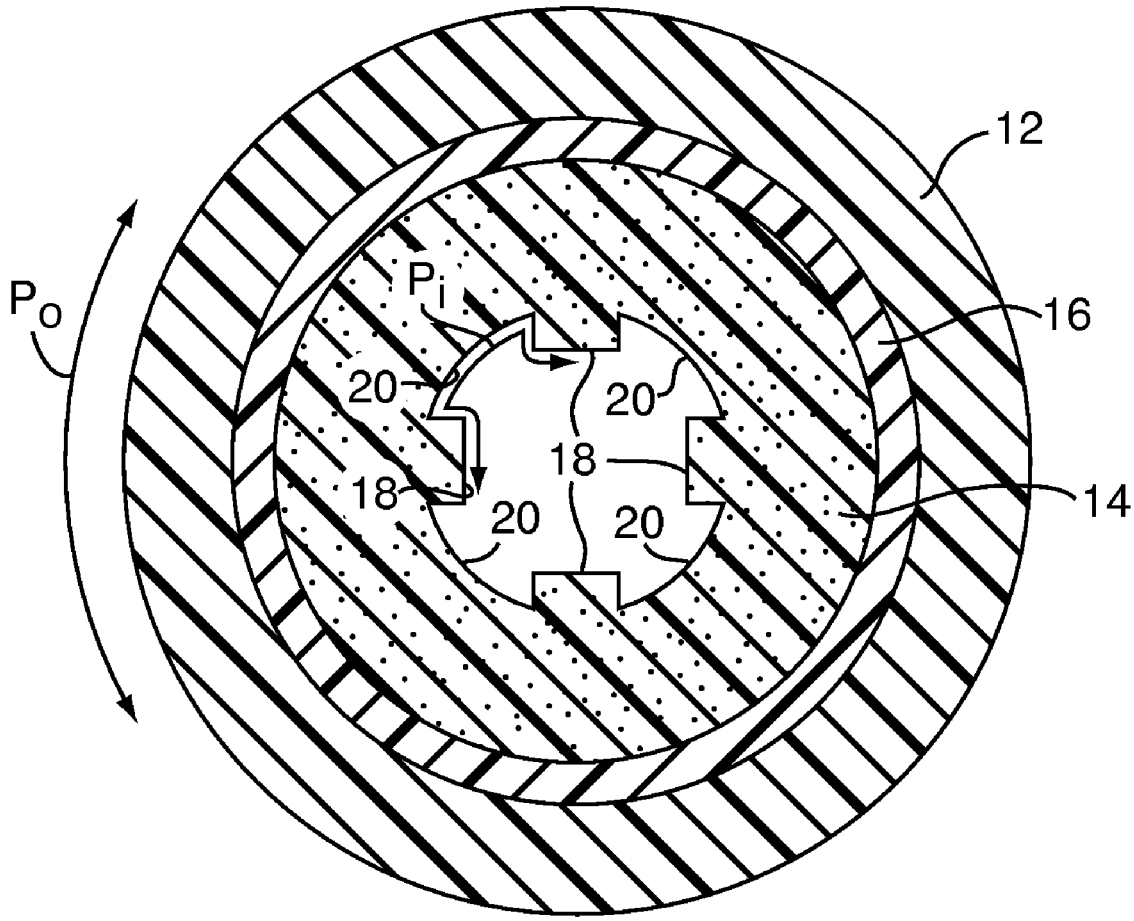
12
16
14
$P_o$
$P_i$
20
20
18
18
20
20

SIGNAL TRANSMISSION FUSE

TECHNICAL FIELD

The present invention relates to improved signal transmission fuse of the type used for transmitting a detonation signal from an initiator to a detonation device. More particularly, the invention relates to an improved tube assembly designed for minimal external size coupled with the capability for handling conventional internal reactive powder loadings.

BACKGROUND OF THE INVENTION

Signal transmission fuse material has become widely used in mining and quarrying operations, as well as in the military, for non-electric blasting of explosive charges from a remote location. The 1971 U.S. Pat. No. 3,590,739 to Persson shows a plastic tube with an outer diameter of approximately 3 mm and an inner diameter of slightly over 1 mm such that the ratio of the inner to the outer circumference of the tube is approximately 0.35 or less. The interior bore of the tube is coated with a reactive material. The reactive powder material has evolved since the date of the Persson patent and the most common coating material now used is a mixture of HMX and aluminum powder as disclosed in the U.S. Pat. No. 4,328,753.

The U.S. Pat. No. 4,328,753 patent issued in 1982 discloses a low energy fuse in the form of a plastic tube having concentric tubular plies, the inner ply comprising SURLYN (Dupont), to which material the reactive powder material can be conveniently coated. The outer tube or ply is preferably fabricated from a mechanically tougher material having greater tensile strength and abrasive resistance, as well as being less expensive. Thus, the outer material may comprise a polyamide or polypropylene or polyolefin or similar polymer designed to withstand the stress encountered at a worksite. This prior art U.S. Pat. No. 4,328,753 suggests that the outer diameter be 3 mm, and the inner diameter be 1.3 mm, and that the core loading be 2.7 grams of reactive material per square meter of inside surface area.

U.S. Pat. No. 5,212,341 suggests a coextruded triple plastic layer shock tube designed with the intermediate layer providing better bonding between the inner and outer plies. Finally, U.S. Pat. 5,597,973 suggests reducing the outer diameter of the polymeric shock tube to approximately 2.15 mm, and the wall thickness being approximately 0.7 mm or less. The resulting shock tube has about 2.7 grams per square meter reactive powder loading from the 1982 U.S. Pat. No. 4,328,753 mentioned previously.

All of these prior art patents suggest that any practical shock tube comprises an annular cross section such that the inner diameter of the shock tube is dictated by the reactive powder loading in g/m2 and the outer diameter is dictated by the wall thickness required to contain the percussive pressures created inside the tube.

SUMMARY OF THE INVENTION

In accordance with the present invention a signal transmission fuse is disclosed, wherein the elongated tube assembly has a conventionally configured cylindrical outer surface of tough polymeric material, such as nylon or the equivalent, and may be fabricated from a plurality of layers, inner, outer and intermediate bonding layer. The inner ply defines an inner surface, which is non-cylindrical, but both inner and outer surfaces have a constant cross section through out the length of the elongated tube assembly. A reactive powder is adhered to the non-circular inner surface, at a powder density in the range of 0.45 to 2.65 grams per square meter. This elongated non-cylindrical inner surface has a non-circular cross section of closed contour with a peripheral extent ($P_i$) (in a radial plane) bearing a fractional relationship to the outer surface perimeter ($P_o$) in the range of 0.4 to 0.5. Well above that currently available, the elongated outer cylindrical surface, which is of circular cross section has a diameter (OD) less than 2.5 mm. Thus, the outer periphery or circumference ($P_o$) of the tube assembly cross section is that of a circle of OD less than 2.5 mm. The inner cross sectional periphery ($P_i$) is greater than that of the circle which would be available with a cylindrical bore, given the need for a wall thickness in the range of 0.8-0.7 mm, required to withstand the internal and external forces of shock tube.

Thus, a relatively small diameter signal transmission tube is disclosed, having conventional reactive powder loadings in grams per square meter as distinguished from transmission tubes of the type in U.S. Pat. No. 5,597,973 from 1997.

In the preferred embodiment of the invention the inner surface of the inner most ply in the polymeric tube assembly has a plurality of longitudinally extending radially inwardly projecting ribs. These ribs define a plurality of flutes between the ribs so that the ribs and the flutes form a non-cylindrical inner surface of variable radius throughout the length of the tube. This variable radius inner surface of the tube provides at least 25%, and preferably over 30% increase in area of the inner surface of the tube, as compared to that possible with a cylindrical bore for example. Increases in surface area are achieved in the range of 25% to 40% over circular inner diameters now available. Yet the inner surface area of the tube, is such that the charge held by that surface area, is comparable to tubes of larger outside diameter. This is accomplished without sacrifices to wall thickness or to the powder loading in this unique tube shape.

The signal transmission tube of the present invention affords a rugged tube having a minimum wall thickness in the range of 0.8 to 0.87 mm. This is a decided advantage over that set forth in the prior art U.S. Pat. No. 5,597,973 discussed previously.

BRIEF DESCRIPTION OF THE DRAWING

The drawing shows in cross section a signal transmission fuse or shock tube in accordance with the present invention.

DETAILED DESCRIPTION OF THE PREFERRED EMBODIMENT

The drawing shows in cross section the elongated tube assembly of the present invention. The outermost layer or ply 12 has an outer diameter of 2.159 mm. The outer surface for the tube assembly is of generally cylindrical configuration. This outer layer or ply 12 comprises polyethylene or nylon, or an equivalent polymeric material having sufficient tensile strength, abrasive resistance, and economy of material cost so as to afford a rugged sheath for the interior components to be described.

An inner layer or ply 14 is preferably fabricated from SURLYN, a proprietary product of Dupont. SURLYN is an ionomer resin with excellent reactive powder adhesion characteristics. The powder adheres to polymeric SURLYN material by electrostatic or Van der Walls' forces. It has been observed however that even with the use of such materials to define the inner surface of the tube assembly the quantity of powder that can be adhered is limited by the surface area. If excess powder is introduced, the powder will tend to migrate in the tube and lead to an excessive concentrations of powder at certain locations in the tube, causing a tendency to rupture or for the tube to blow out instead of transmitting the percussive signal along the tube in a controlled fashion. It is important to note that the reactive powder adhering to the inner surface of the tube assembly has a surface density in the range of 0.45 to 2.65 grams per square meter rather than the 2.7 grams per square meter at or above suggested in prior art small diameter tubes.

Again with reference to the preferred embodiment of the drawing, the inner and outer plies 12 and 14 are preferably bonded by an intermediate layer 16, and it is a feature of the present invention that these multiple plastic layers 12, 14, and 16 can be coextruded as taught in prior art U.S. Pat. No. 5,212,341 for example.

Again, with reference to the preferred embodiment of the drawing, it will be apparent that the inner surface defined by the inner SURYLN layer 14, rather than being circular in cross section is provided instead with a radius that varies from that dictated by the approximately 0.74 mm internal "diameter" to a minimum radius of dictated by of approximately 0.70 mm. Thus, a variable radius is provided for this inner surface that ranges between 0.7-0.74 mm.

It is an important feature of present invention, that the wall thickness of the overall tube assembly (the difference in radius for the inner and outer surfaces) be maintained in the range of 0.8 to 0.7 mm. The maximum internal opening size for the inside of the tube assembly (as shown) is 0.74 mm. This also dictates that given the outside diameter (2.159 mm) and the radius dictated by this parameter (1.079 mm), that the tube shown has a wall thickness of 1.079-0.37 or 0.71 mm.

In the preferred embodiment than the preferred range for the overall wall thickness for the tube assembly itself should be in the range of 0.7 to 0.8 mm.

Referring now to the preferred shape of the inner surface of the tube assembly, it will be apparent that this inner surface is not cylindrical as a result of a plurality "N" of longitudinally extending, radially inwardly projecting, ribs 18, 18 formed by the inner layer or ply 14 during the extrusion process.

As so constructed and arranged the variable radius inner surface defined by the ribs 18, 18, and the intermediate flute portions 20, 20 between these ribs, provides at least a 25% increase in the area of the inner surface of the tube assembly over that possible with a cylindrical internal bore as suggested in the prior art. Thus, the increase in surface area achieved as a result of the construction shown in the present disclosure, provides an increase in the internal surface area of 25% to 40% over that possible with a cylindrical bore, while maintaining a conventional relationship between wall thickness and outside diameter as described above. Preferably, this inner surface area increase is on the order of 30% with the geometry shown in the drawing. Indeed, given the cruciform configuration shown for the inside passageways of the tube assembly of the present invention, the sharp interior angles afforded by the cruciform shape itself yield even greater powder loading capability than possible with a smooth bore prior art shock tube. While powder surface density in the conventional range of 0.45 to 2.65 grams per square meter are preferred, it is a feature of the present invention that the possible-powder surface density be in a wider range, 1.4 to 7 grams per square. At these powder surface densities (1.4 to 7.0 grams per square meter) a marked improvement in powder loadings per linear meter of tubing can be achieved. More particularly, instead of only 3.24 to 16.2 milligrams per linear meter as would be the case given a cylindrical internal bore of approximately 0.74 mm diameter, with the cruciform shape of the present invention, and the same powder surface density (in the range of 4.2 to 21 milligrams per linear meter loading for the powder). Over a 30% increase in loading for the reactive powder material in a small diameter (less than 0.10" or 2.5 mm) shock tube or signal transmission fuse is achieved.

In light of the above, it is therefore understood that within the scope of the appended claims the invention may be practiced otherwise than as specifically described.

I claim:

1. A signal transmission fuse comprising:

an elongated tube assembly having a cylindrical outer surface of perimeter $P_o$, and a non-cylindrical inner surface, said inner and outer surfaces being of radial constant cross section along the longitudinal length of said tube assembly, a reactive powder adhering to said non-circular inner surface at a powder surface density in the range of 1.4 to 7 grams per square meter, said elongated non-cylindrical inner surface having a non-circular cross section of closed contour of peripheral extent ($P_i$) such that the ratio $P_i/P_0$ lies in the range of 0.4 to 0.5, said outer and inner peripheries defining a variable wall thickness around the tube assembly axis such that said inner periphery is defined by radially inwardly extending ribs and adjacent outwardly expanded flutes that provide a minimal wall thickness in the range of 0.8-0.7 mm, whereby said inner periphery ($P_i$) is 25% 40% greater than that provided with a cylindrical bore of said minimum wall thickness, said elongated outer cylindrical surface having a circular cross section of a diameter less than 2.5 mm.

2. The signal transmission fuse according to claim 1, wherein said tube assembly has a plurality of layers or plies, and includes an innermost ply defining said non-cylindrical inner surface, and an outermost ply defining said outer cylindrical surface.

3. The signal transmission fuse according to claim 2, wherein said most ply is of polymeric material exhibiting good adherence for said reactive powder, and wherein said outermost ply is a polymeric material selected for its tensile strength, abrasive resistance, and economic cost.

4. The signal transmission fuse according to claim 3, wherein said outermost ply is fabricated from a polymeric material selected from the group consisting essentially of polyethylene, nylon, polyurethane, and a polyether block amide polymer.

5. The signal transmission fuse according to claim 3, wherein said outermost ply is fabricated from a polymer selected from the group consisting essentially of polyethylene, nylon, polyurethane, and a polyether block amide polymer.

6. The signal transmission fuse according to claim 2, wherein said inner ply is fabricated from a polymer selected from the group consisting essentially of SURLYN (Dupont) and PRIMACOR D (Dow).

7. The signal transmission fuse according to claim 2, wherein said inner non-cylindrical surface shape is of a generally cruciform cross section with said circum axially arranged ribs in equally spaced relation around the centerline of said tube assembly.

* * * * *